US006236381B1

(12) United States Patent
Kurata et al.

(10) Patent No.: US 6,236,381 B1
(45) Date of Patent: May 22, 2001

(54) IMAGE DISPLAY APPARATUS

(75) Inventors: Takatsugu Kurata; Michio Ohsugi; Hironari Taniguchi, all of Osaka; Koji Matsuo, Hyogo; Kanji Imai, Osaka, all of (JP)

(73) Assignee: Matsushita Electronics Corporation, Osaka (JP)

( * ) Notice: Subject to any disclaimer, the term of this patent is extended or adjusted under 35 U.S.C. 154(b) by 0 days.

(21) Appl. No.: 09/198,167

(22) Filed: Nov. 23, 1998

(30) Foreign Application Priority Data

Dec. 1, 1997 (JP) ..... 9-330632

(51) Int. Cl.[7] ..... H01J 31/12

(52) U.S. Cl. ..... 345/74.1; 315/169.3; 313/495; 313/422; 345/75

(58) Field of Search ..... 345/74.1, 74.2, 345/75; 313/169.3; 315/495, 422

(56) References Cited

U.S. PATENT DOCUMENTS

| | | | |
|---|---|---|---|
| 3,875,442 | 4/1975 | Wasa et al. . | |
| 4,145,633 | 3/1979 | Peters . | |
| 4,404,493 | 9/1983 | Nonomura et al. . | |
| 4,672,272 | 6/1987 | Littwin . | |
| 4,891,552 | 1/1990 | Moriyama et al. | 313/495 |
| 4,900,981 | 2/1990 | Yamazaki | 313/422 |
| 4,908,539 | 3/1990 | Meyer | 315/169.3 |
| 5,083,058 | 1/1992 | Nonomura et al. . | |
| 5,504,387 | 4/1996 | Hamagishi | 313/310 |
| 5,565,742 | 10/1996 | Shichao et al. . | |
| 5,652,083 | 7/1997 | Kumar et al. | 430/315 |
| 5,859,508 | 1/1999 | Ge et al. . | |
| 5,949,395 | 9/1999 | Stevens et al. . | |

FOREIGN PATENT DOCUMENTS

| | | | |
|---|---|---|---|
| 0 172 089 | 2/1986 | (EP) | H01J/31/12 |
| 0 312 007 | 4/1989 | (EP) | H01J/31/12 |
| 0 316 871 | 5/1989 | (EP) | H01J/31/12 |
| 0 404 022 | 12/1990 | (EP) | H01J/31/12 |
| 0 572 777 | 12/1993 | (EP) | H01J/31/12 |
| 0 614 209 | 9/1994 | (EP) | H01J/31/12 |
| 0 628 982 | 12/1994 | (EP) | H01J/31/12 |
| 739 029 | 10/1996 | (EP) | H01J/31/12 |
| 53-38260 | 4/1978 | (JP) | H01J/31/12 |
| 53-74357 | 7/1978 | (JP) | H01J/31/12 |
| 2-61946 | 3/1990 | (JP) | H01J/31/12 |
| 3-149728 | 6/1991 | (JP) | H01J/3/12 |
| 8-236044 | 9/1996 | (JP) | H01J/31/12 |
| 96/30926 | 10/1996 | (WO) | H01J/31/12 |
| 97/15912 | 5/1997 | (WO) | G09G/3/22 |

*Primary Examiner*—Amare Mengistu
(74) *Attorney, Agent, or Firm*—Merchant & Gould P.C.

(57) ABSTRACT

An image display apparatus comprises, in a vacuum container whose inside is kept under vacuum, a fluorescent layer, an electron emission source having a plurality of electron sources, a deflecting electrode to deflect electron beams emitted from the electron emission source, and an ultrafocusing electrode to focus the electron beams and land the focused electron beams on predetermined positions of the fluorescent layer. The ultrafocusing electrode is arranged between the electron emission source and the fluorescent layer while the deflecting electrode is arranged between the electron emission source and the ultrafocusing electrode, so that the fluorescent layer is illuminated by the electron beams. If the landing position of the electron beam is deviated because of errors such as manufacturing errors in assembling the components into the image display apparatus, the deviation is minimized and an image display apparatus with high resolution can be obtained.

6 Claims, 8 Drawing Sheets

IMAGE DISPLAY APPARATUS

FIELD OF THE INVENTION

The present invention relates to an image display apparatus, and more particularly relates to a thin image display apparatus used for a video camera and the like.

BACKGROUND OF THE INVENTION

Conventionally, cathode ray tubes have been used mainly as image display apparatuses for color televisions, personal computers and the like. However, in recent years, image display apparatuses have been required to be miniaturized, and made lighter and thinner. In order to satisfy these demands, various types of thin image display apparatus have been developed and commercialized.

Under these circumstances, various types of thin image display apparatus have been researched and developed recently. In particular, liquid crystal displays and plasma displays have been developed actively. The liquid crystal displays have been applied to various types of products such as portable personal computers, portable televisions, video cameras, carnavigation systems and the like. In addition to that, the plasma displays have been applied to products such as large-scale displays, for example, 20 inch-displays or 40-inch displays.

However, problems of such a liquid crystal display include a narrow visual angle and a slow response. Regarding a plasma display, high brightness can't be obtained and the consumed electricity is large. A thin image display apparatus called a field emission image display apparatus has attracted considerable attention to solve these problems. The field emission image display apparatus uses field emission, or a phenomenon in which electrons are emitted in a vacuum at room temperature. The field emission image display apparatus is a spontaneous luminescent type, and therefore it is possible to obtain a wide visual angle and high brightness. Further, the basic principle (to illuminate a fluorescent substance with electron beams) is same as that of a conventional cathode ray tube, and therefore a picture with natural color and high reproduction can be displayed.

The above-mentioned type of a field emission image display apparatus is disclosed in Unexamined Published Japanese Patent Application (Tokkai-Hei) No. 1-100842. Another image display apparatus disclosed in Tokkai-Hei No. 2-33839 is known as a spontaneous light emission type image display apparatus with high-quality images, which is different from the above-mentioned field emission image display apparatus in the structure but uses a linear hot cathode.

FIG. 7 is a perspective exploded view showing a first conventional image display apparatus (refer to Tokkai-Hei No. 2-33839). As shown in FIG. 7, the conventional image display apparatus comprises a back electrode 100, a linear cathode 101, an electron beam-attracting electrode 102, a control electrode 103, a first focusing electrode 104, a second focusing electrode 105, a horizontal deflecting electrode 106, a vertical deflecting electrode 107, a front glass container 109*a* having a fluorescent layer 108 on the inner surface, and a rear glass container 109*b*. The back electrode 100, the linear cathode 101, the electron beam-attracting electrode 102, the control electrode 103, the first focusing electrode 104, the second focusing electrode 105, the horizontal deflecting electrode 106 and the vertical deflecting electrode 107 are contained between the rear glass container 109*b* and the front glass container 109*a* (the fluorescent layer 108 side), and the space where those components are contained between the glass containers (109*a*, 109*b*) is maintained under vacuum.

In the image display apparatus, electron beams are formed in a matrix by the linear cathode 101 and the electron beam-attracting electrode 102, and focused by using the first focusing electrode 104 and the second focusing electrode 105. The electron beams are further deflected by the horizontal deflecting electrode 106 and the vertical deflecting electrode 107 before being landed on predetermined positions of the fluorescent layer 108. The control electrode 103 controls the electron beams over time, and adjusts each electron beam independently according to picture signals for displaying pixels.

FIG. 8 is a cross-sectional view showing the schematic structure of a second conventional image display apparatus (refer to Tokkai-Hei No. 1-100842). As shown in FIG. 8, the conventional image display apparatus comprises an electron emission source 210, fluorescent layers 208*a* and 208*b*, a faceplate 209 and a transparent electrode 207. The fluorescent layers 208*a* and 208*b* are provided on the faceplate 209 via the transparent electrode 207 and the fluorescent layers 208*a* and 208*b* face the electron emission source 210 in parallel. The electron emission source 210 comprises a substrate 204, a thin film 202 formed on the substrate 204 and electrodes 201*a* and 201*b*, which are provided for applying a voltage to the thin film 202. An electron emission part 203 is provided by processing the thin film 202.

According to the above-mentioned image display apparatus, the deflection of electron beams emitted from the electron emission part 203 is adjusted by controlling a voltage applied to the electrodes 201*a* and 201*b*, and the deflected electron beams are landed on predetermined positions of the fluorescent layers 208*a* and 208*b* to illuminate these fluorescent layers. The conventional image display apparatus is also provided with a flat electrode (not shown in FIG. 8) between the electron emission source 210 and the fluorescent layers (208*a*, 208*b*). In the disclosed technique, the voltage applied to the flat electrode is lower than that of the transparent electrode 207 in order to focus the electron beams on the fluorescent layers by utilizing the lens effect. Since the flat electrode is designed only to adjust the deflection degree for the inherently-deflected electron beams, it does not function to deflect the electron beams actively.

The respective components for the image display apparatuses in the conventional technique are thin and flat. Therefore, a combination of these components can form a thin image display apparatus having a flat screen.

In the image display apparatus according to the conventional technique, however, errors will occur during manufacturing or assembling the respective components. Such errors will affect directly the deviation of the landing position of an electron beam. For example, in an image display apparatus where one pitch of an electron source corresponds to one stripe pitch of the fluorescent layer, 10 $\mu$m deviation of the electron source results in 10 $\mu$m deviation of the position that the electron beam is landed on the fluorescent layer. Accuracy variations such as deviation of the deflection electrode and differences in level will also result in direct influences on the deviation of the landing positions for the electron beams. Therefore, in such an image display apparatus, landing an electron beam on a predetermined position of a fluorescent layer is difficult when the positions of the components comprising the electron sources and the deflection electrode are deviated. As a result, more inconveniences such as overlap irradiation may occur, and thus, the image quality of the image display apparatus will deteriorate, and an image display apparatus with high resolution cannot be easily obtained.

In order to improve the resolution of an image display apparatus, electron beams should be further focused (i.e., a spot diameter of an electron beam should be reduced), and the electron beam should be landed on a fluorescent layer with higher accuracy. In a conventional image display apparatus, however, a remarkable improvement cannot be obtained because of the structural limitations, even by using regular actions including deflecting actions. For example, the spot diameter should be decreased to ⅕ and also the landing accuracy, to ⅕ or less in order to improve the solution by 5 times, which is considerably difficult in the conventional technique.

SUMMARY OF THE INVENTION

In order to solve the above-mentioned problems, this invention provides an image display apparatus in which sharply-focused electron beams are landed with high accuracy on a fluorescent layer. Such an image display apparatus can provide high resolution that cannot be obtained by any regular deflecting actions or the like, and also can minimize deviation of electron beam's landing. Such a deviation is caused by errors like manufacturing errors during assembly of the components into the image display apparatus.

In order to achieve the above-mentioned purpose, an image display apparatus of this invention comprises, in a vacuum container whose inside is kept under vacuum, a fluorescent layer, an electron emission source having an electron source, a deflecting electrode functioning to deflect an electron beam emitted from the electron emission source, and an ultrafocusing electrode functioning to focus the electron beam deflected at the deflecting electrode and to land the focused electron beam on a predetermined position of the fluorescent layer. Slits are formed on the ultrafocusing electrode and the slit pitch is equal to the array pitch of the electron beams. Stripes are formed on the fluorescent layer with a pitch of 1/an integer (e.g., 1/1, 1/2, 1/3 . . . ) of the slit pitch on the ultrafocusing electrode. The ultrafocusing electrode is arranged between the electron emission source and the fluorescent layer, while the deflecting electrode is arranged between the electron emission source and the ultrafocusing electrode. A slit forms a focusing lens when a voltage is applied to the ultrafocusing electrode, and the focusing lens provided with predetermined focusing power and refracting power will land the electron beam on a predetermined position of the fluorescent layer, and thus, the fluorescent layer is illuminated.

In an image display apparatus of this invention, the ultrafocusing electrode forms the focusing lens having a predetermined focusing power and refracting power. Therefore, an electron beam with minimized spot diameter can be landed on a predetermined position of the fluorescent layer by deciding a position to emit the electron beam for entering the focus lens and also a position of the focusing lens. In order to provide a 1/N pitch (here, N is an integer) for the fluorescent layer, i.e., when N-times resolution is required by using the focusing lens, both the spot diameter and the landing accuracy can be made 1/N in theory by setting the lateral magnification of the lens to be 1/N. As a result, an image display apparatus with high resolution can be provided in a simple manner. The electron beam is focused by the ultrafocusing electrode and further refracted to be landed on the predetermined position of the fluorescent layer, and thus, influence by the deviation of the electron beam landing on the fluorescent layer can be minimized, since focusing at the ultrafocusing electrode decreases the deviation of the electron beam landing caused by errors such as manufacturing errors which may occur during assembling the components into an image display apparatus.

In the above-mentioned image display apparatus, influences of deviation due to errors in manufacturing or the like can be minimized by focusing the electron beam and landing the electron beam with high accuracy. As a result, certain problems such as overlap irradiation, that is, irradiation of an electron beam on a plurality of components of fluorescent substance at the same time, can be prevented and an image display apparatus having high resolution can be obtained.

Preferably in the image display apparatus of the invention, the electron emission source has a plurality of electron sources arranged in a matrix.

A preferable image display apparatus of this invention has electron sources that can be driven equivalently in a matrix. There is no specific limitation on the configuration of the electron sources. For example, an electron source, which is divided and arranged in stripes, or which is arranged continuously over a surface of a substrate, may be used.

In an image display apparatus of this invention, the electron emission source can comprise linear cathodes strung in parallel.

Furthermore in a preferable image display apparatus of this invention, the distance from the fluorescent layer to the ultrafocusing electrode is shorter than the distance from the ultrafocusing electrode to the deflecting electrode which is arranged at the closest position to the ultrafocusing electrode. A deflecting electrode arranged at the closest position to the ultrafocusing electrode indicates a deflecting electrode in a layer positioned the closest to the ultrafocusing electrode, when plural layers of deflecting electrodes are laminated in the thickness direction of the image display apparatus. In this preferable embodiment, bringing the ultrafocusing electrode close to the fluorescent layer corresponds to bringing a lens closer to the image screen rather than an object's surface, and thus, the magnification of the lens can be reduced easily. As a result, the spot diameter of the electron beam landed on the fluorescent layer can be further focused, and the effect by the deviation is also decreased. In this way, an image display apparatus with further improved resolution can be provided easily.

A deflecting electrode in this invention indicates an electrode conducting controls required to deflect electron beams. The deflecting electrode can comprise only one layer of electrode in the orbital direction of the electron beams, or a group of electrodes formed by laminating plural electrode layers in the orbital direction. The deflection electrode can be provided with some additional control functions including focusing of an electron beam and reshaping the beam as well as a function of deflecting an electron beam.

DETAILED DESCRIPTION OF THE PREFERRED EMBODIMENT

Hereinafter, examples of an image display apparatus of this invention will be described referring to the accompanying drawings.

(A First Embodiment)

Figure 1:
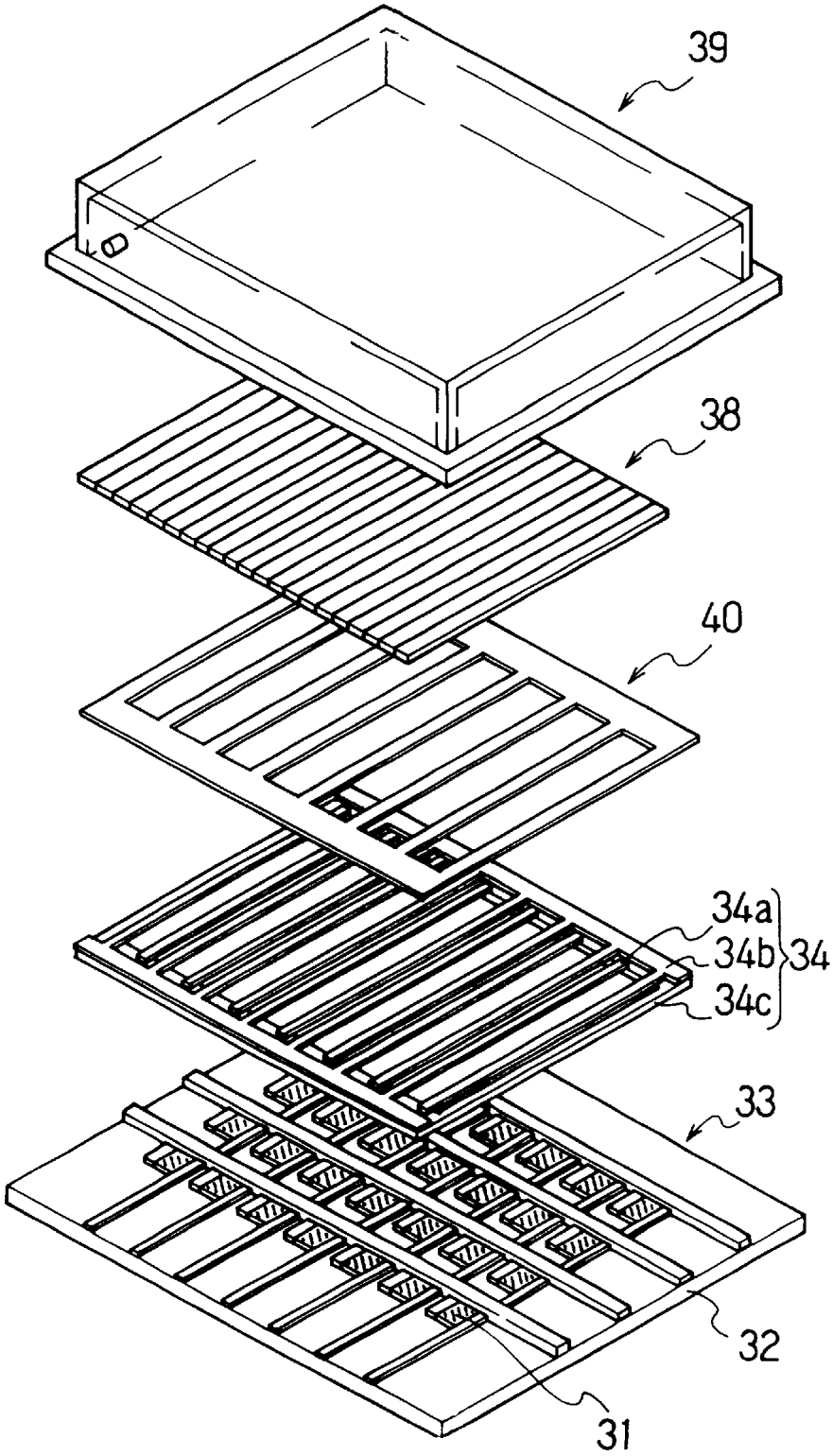
FIG. 1 is a perspective exploded view showing an image display apparatus in a first embodiment of this invention.

FIG. 1 is a perspective exploded view showing an image display apparatus in a first embodiment of this invention. As shown in FIG. 1, an image display apparatus in the first embodiment comprises an electron emission source 33, an electrode (deflecting electrode) 34, an ultrafocusing electrode 40, a fluorescent layer 38 and a vacuum container 39. The electron emission source 33 comprises a plurality of electron sources 31 that are arranged in a matrix. The electrode 34 has a function for deflecting and focusing electron beams emitted from the electron emission source 33. The ultrafocusing electrode 40 has a function for further focusing the electron beams and landing them on predetermined positions of the fluorescent layer 38. The fluorescent layer 38 is excited and illuminated by the electron beams. The vacuum container 39 contains the electron emission source 33, the electrode 34, the fluorescent layer 38 and the ultrafocusing electrode 40, and the inside of the vacuum container 39 is kept under vacuum.

The electrode 34 is arranged between the electron emission source 33 and the fluorescent layer 38, while the ultrafocusing electrode 40 is arranged between the electrode 34 and the fluorescent layer 38. The fluorescent layer 38 is provided at a position that contacts with the inner surface of the vacuum container 39. The part of the vacuum container 39 that contacts with the fluorescent layer 38 is made of transparent material in order to observe a light emitted by the fluorescent layer 38 from the outside. The inside of the vacuum container 39 may have a degree of vacuum in a range between $10^{-6}$ and $10^{-8}$ torr.

The electron emission source 33 is formed by arranging the electron sources 31 in a matrix on an insulating substrate 32. Any type of an electron emission source 31 can be used as long as it can emit electron beams. For example, an electron emission source, which is composed of a surface conductive component composed of a thin film of $SnO_2$(Sb) or a thin film of Au and the like or a thin film of other material, a microchip type electric field electron emission component such as Spindt type (microchip cathode of the field emission type invented by Spindt), an electric field electron emission component having the MIM type structure or the similar structure or a cold cathode ray component composed of an electron emission material which is carbon material such as diamond, graphite, DLC (Diamond Like Carbon) and the like, may be used.

The electrode 34 includes a first interdigital electrode 34*a*, a second interdigital electrode 34*b* and an insulating substrate 34*c*. The first interdigital electrode 34*a* and the second interdigital electrode 34*b* are arranged so that the components of the first interdigital electrode 34*a* and those of the second interdigital electrode 34*b* (interdigital parts) engage each other with an appropriate distance between the electrode components on the insulating substrate 34*c*. According to the above-mentioned structure, a plurality of sets of a pair of interdigital electrodes 34*a* and 34*b* whose each interdigital part has a predetermined distance each other are arranged at a constant distance each other on the same flat surface of the insulating substrate 34*c*. The insulating substrate 34*c* is formed in a configuration so as to maintain the first interdigital electrode 34*a* and the second interdigital electrode 34*b*, and electron beams can scan between each pair of electrodes positioned on the insulating substrate 34*c*. A shape of the insulating substrate 34*c* is, for example, a shape whose center part is vacant and which has only four edges. The electron emission source 33, the electrode 34, the ultrafocusing electrode 40 and the fluorescent layer 38 are assembled such that electron beams emitted in a matrix from the electron emission source 33 are appropriately focused and deflected between a pair of electrodes consisting of the first interdigital electrode 34*a* and the second interdigital electrode 34*b* in a certain direction corresponding to picture signals etc., and are landed on the fluorescent layer 38 after being focused further by the ultrafocusing electrode 40. The electrode 34 adjusts the deflecting direction of the electron beams by controlling the voltage applied to the first interdigital electrode 34*a* and the second interdigital electrode 34*b*, so that the average electric field between the fluorescent layer 38 and the electrode 34 is intensified as compared to the average electric field between the electrodes 34 and the electron emission source 33. As a result, the focusing condition of the electron beams is adjusted.

A fluorescent layer 38 is prepared by applying a fluorescent substance on a substrate such as a glass substrate. The fluorescent substance is illuminated by irradiation of electron beams emitted from the electron emission source 33. In coating a fluorescent substance on a glass substrate, in order to provide a fluorescent layer 38 which can display a colored image, the fluorescent substance is coated in numerous stripes on the glass substrate in order of red (R), green (G) and blue (B). The stripe-arranged fluorescent substance can be provided by a method for printing directly on a glass substrate such as a screen-stencil or a method for transferring a material, which is printed on the resin sheet beforehand, to a glass substrate by applying heat or pressure. In addition to that, the stripe-arranged fluorescent substance can be provided by photolithography, for example, in the case of providing a cathode ray tube.

A vacuum container 39 is made of a transparent material such as glass. This is because it is required that light emitted from a fluorescent layer 38 be observed from outside of the vacuum container 39 so that the vacuum container 39 functions as an image display apparatus. However, it is not required that the whole surface of the vacuum container 39 be transparent, but only the part of the vacuum container 39 which contacts with the fluorescent layer 38 is transparent (in FIG.1, the upper area with largest surface).

The ultrafocusing electrode 40 is made of a plate component. On the predetermined positions of this plate component, slits are formed with a pitch equal to the array pitch of the electron sources 31. The relationship between the pitch (S) of the slits on this ultrafocusing electrode 40 and the pitch (K) of the stripes of the fluorescent layer 38 is represented by the following Equation 1:

$$K=S/N$$

wherein N is an integer.

Figure 2:
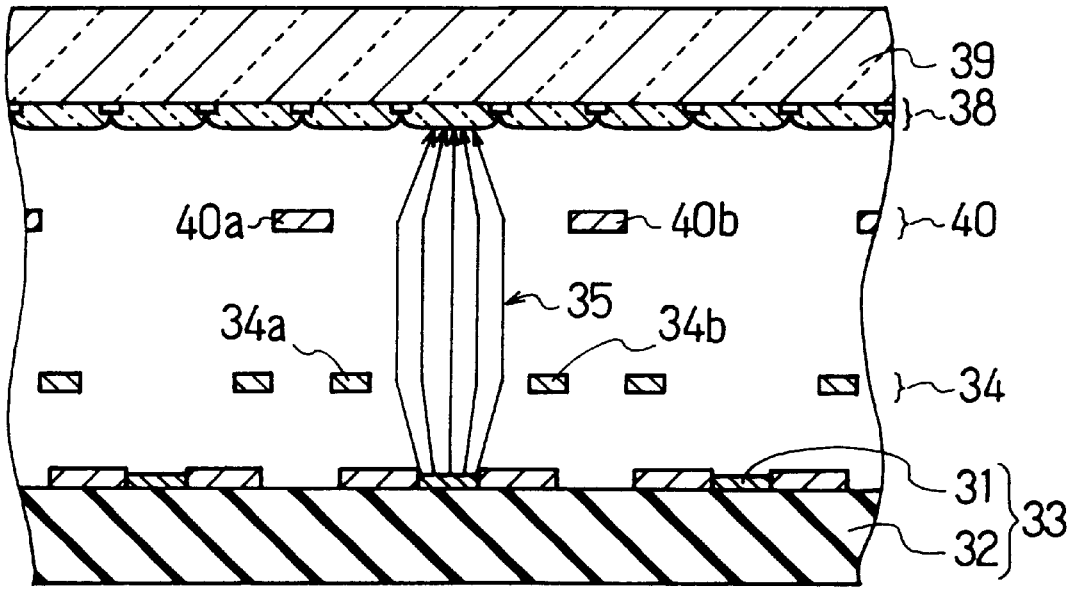
FIG. 2 is a cross-sectional view showing the schematic structure of the image display apparatus shown in FIG. 1.

FIG. 2 is a cross-sectional view showing the schematic structure of an image display apparatus shown in FIG. 1. As shown in FIG. 2, electron beams are emitted appropriately from respective electron sources 31 which composes the electron emission source 33. The electrode 34 and ultrafocusing electrode 40 are arranged in an appropriate way between the electron emission source 33 and the fluorescent layer 38 such that each electron beam emitted from each electron source 31 is focused and deflected appropriately and landed on a predetermined position of the fluorescent layer 38.

Specifically, the ultrafocusing electrode 40 is arranged between the electron emission source 33 and the fluorescent layer 38, while the electrode 34 is arranged between the electron emission source 33 and the ultrafocusing electrode 40. The distance from the fluorescent layer 38 to the ultrafocusing electrode 40 is determined to be shorter than that from the ultrafocusing electrode 40 to the electrode 34. Bringing the ultrafocusing electrode 40 closer to the fluorescent layer 38 corresponds to bringing a lens closer to an image surface rather than an object surface. As a result, the magnification of the focusing lens can be decreased easily and the spot diameter of the electron beams landed on the fluorescent layer 38 can be further minimized, and high resolution can be obtained in a simple manner. Due to the relationship shown in the Equation 1 between the ultrafocusing electrode 40 and the fluorescent layer 38, when an N-grade deflection is conducted in the electrode 34, the pitch in the fluorescent layer 38, which reflects the resolution of actually-displayed images, can be small to be N times over the ultrafocusing electrode 40 without increasing the number of the ultrafocusing electrode 40. As a result, the resolution of the displayed images can be improved without providing any complicated ultrafocusing electrode 40, for example, by providing plural electrodes. Especially in this embodiment, the spot diameter of the electron beam can be further decreased, and thus, so-called error irradiation or overlap irradiation can be prevented even if the pitch of the fluorescent layer 38 is reduced. Error irradiation means that an electron beam stimulates and illuminates certain parts rather than the predetermined part of the fluorescent layer. Overlap irradiation means that an electron beam stimulates and illuminates plural parts of the fluorescent layer at the same time. In conclusion, the pitch fineness of the fluorescent layer 38, which reflects the resolution of the displayed images, can be determined without limitation from the spot diameter of the electron beams.

The ultrafocusing electrode 40 in this embodiment has the above-mentioned structure, so intensive focusing lenses are formed in the spaces between respective electrodes (slit parts) composing the ultrafocusing electrode 40 by applying a voltage to the ultrafocusing electrode 40. Hereinafter, actions and effects etc. of an image display apparatus of this embodiment will be explained by illustrating an action of an electron beam 35 which is emitted from an electron source 31.

An electron beam 35 is emitted from an electron source 31 to pass between a pair of electrodes 34*a*, 34*b* which constitute an electrode 34, and is deflected by a potential of the electrode 34*a* and that of the electrode 34*b* to any direction. In FIG. 2, the electrodes 34*a* and 34*b* are supplied with a potential required for the electron beam 35 to travel in a straight line. Then, the electron beam 35 passes between a pair of electrodes 40*a*, 40*b* which constitute an ultrafocusing electrode 40. As an intensive focusing lens is formed between a pair of electrodes 40*a* and 40*b* composing the ultrafocusing electrode 40, the electron beam 35 passing between the electrodes 40*a* and 40*b* is focused intensively and landed on a predetermined position of the fluorescent layer 38. In this embodiment where an electron beam is focused intensively, the electron beam can be further focused compared to the conventional technique, and an image display apparatus will have high resolution.

As the ultrafocusing electrode 40 provides intensive focusing action and refracting action on the electron beams in this embodiment, an electron beam will be landed inherently on a predetermined position of the fluorescent layer 38 if the positions of the electron source 31 to emit the electron beam and the position of a pair of electrodes composing the ultrafocusing electrode 40 are determined. This action is further explained later referring to FIG. 3.

Figure 3:
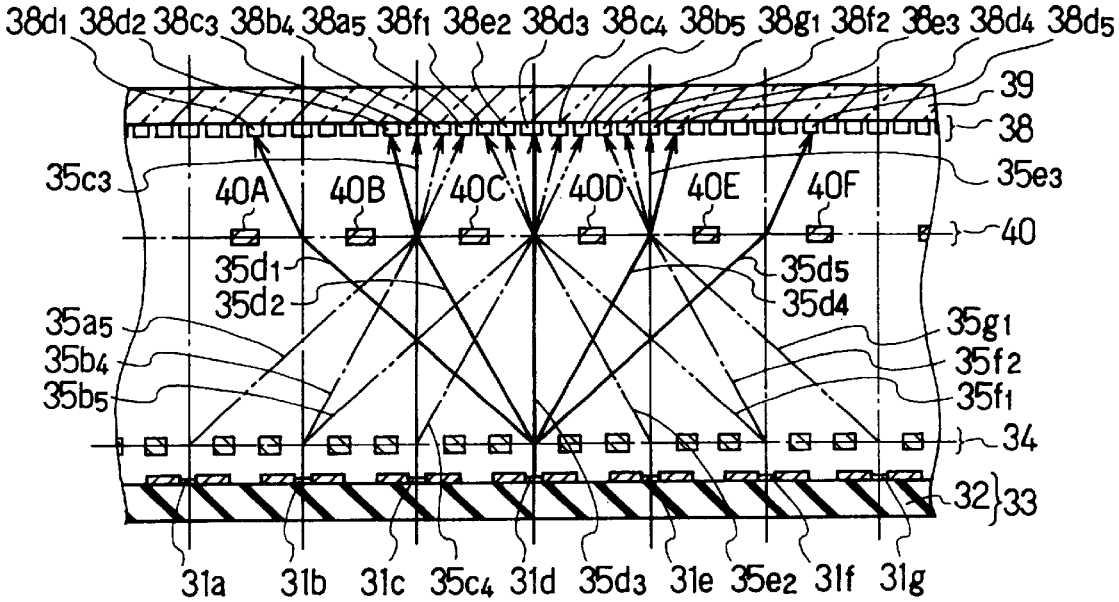
FIG. 3 is a cross-sectional view showing the relationship between the ultrafocusing electrodes comprising the image display apparatus shown in FIG. 1 and the landing positions of electron beams.

FIG. 3 is a cross-sectional view showing the relationship between the ultrafocusing electrode and the landing positions of the electron beams in the image display apparatus shown in FIG. 1. The electron emission source 33 of the image display apparatus shown in FIG. 3 comprises an insulating substrate 32 provided with a first electron source 31*a*, a second electron source 31*b*, a third electron source 31*c*, a fourth electron source 31*d*, a fifth electron source 31*e*, a sixth electron source 31*f* and a seventh electron source 31*g* thereon. Above the electron emission source 33, an electrode 34 is provided to focus and deflect electron beams. An ultrafocusing electrode 40 is provided above the electrodes 34. A first focusing lens is formed between a first electrode 40A and a second electrode 40B, a second focusing lens is formed between the second electrode 40B and a third electrode 40C, a third focusing lens is formed between the third electrode 40C and a fourth electrode 40D, a fourth focusing lens is formed between the fourth electrode 40D and a fifth electrode 40E, and a fifth focusing lens is formed between the fifth electrode 40E and a sixth electrode 40E Above the ultrafocusing electrode 40, a fluorescent layer 38 is provided, therefore, electron beams controlled by the electrode 34 and the ultrafocusing electrode 40 are landed on the predetermined positions of the fluorescent layer 38.

The action of the ultrafocusing electrode 40 is explained referring to an electron beam emitted from the fourth electron source 31*d*. An electron beam emitted from the fourth electron source 31*d* is limited (focused) to be a predetermined size by the electrode 34 and deflected in a predetermined direction according to the potential of a pair of electrodes 34 sandwiching the electron beam. In this embodiment, the potential of the electrode 34 is adjusted to conduct deflection in five grades and to pass the deflected electron beams through appropriate positions of the respective focusing lenses of the ultrafocusing electrode 40. Therefore, the electron beam emitted from the fourth electron source 31*d* is deflected to any of electron beam $\mathbf{35}d_1$, passing through the first focusing lens, electron beam $\mathbf{35}d_2$ passing through the second focusing lens, electron beam $\mathbf{35}d_3$ passing through the third focusing lens, electron beam $\mathbf{35}d_4$ passing through the fourth focusing lens, and electron beam $\mathbf{35}d_5$ passing through the fifth focusing lens, according to certain control signals such as picture signals.

Each focusing lens is formed to have very small magnification and aberration in view of lens optics. If an electron beam enters a focusing lens with a certain angle, it will exit the lens with an angle corresponding to the incident angle. In this embodiment, an electron beam $\mathbf{35}d_3$, entering the third focusing lens vertically above the fourth electron source 31*d*, is focused without deflection and travels in a straight line until being landed on a predetermined fluorescent layer $\mathbf{38}d_3$. An electron beam $\mathbf{35}d_2$enters the second focusing lens after being deflected to the left by one grade, and is landed on a predetermined fluorescent layer $\mathbf{38}d_2$ by the refracting action of the second focusing lens. An electron beam $\mathbf{35}d_1$ enters the first focusing lens after being deflected to the left by two grades, and is landed on a predetermined fluorescent layer 38$d_1$ by the refracting action of the first focusing lens. An electron beam 35$d_4$ enters the fourth focusing lens after being deflected to the right by one grade, and is landed on a predetermined fluorescent layer 38$d_4$ by the refracting action of the fourth focusing lens. An electron beam 35$d_5$ enters the fifth focusing lens after being deflected to the right by two grades, and is landed on a predetermined fluorescent layer 38$d_5$ by the refracting action of the fifth focusing lens.

In a conventional image display apparatus, electron beams are deflected by applying an electric field in a vertical direction to the orbital direction of the electron beams. Such an image display apparatus controls the electron beams from the electron source to be landed on a fluorescent layer arranged vertically above the electron source and also on another fluorescent layer adjacent to the former fluorescent layer. When the conventional controlling method is used to land a electrode beam on a fluorescent layer at a distance away from the electron source as shown in this embodiment, an intensive electric field should be formed by applying an extremely large voltage between the ultrafocusing electrodes sandwiching the electron beam (e.g., between the third electrode 40C and the fourth electrode 40D sandwiching the electron beam 35$d_3$ from the fourth electron source 31$d$). An electron beam is further accelerated as it leaves the electron source, and a more intensive electric field is required for the deflection as the electron beam speeds up. Therefore, a larger voltage should be applied between the pairs of ultrafocusing electrodes. In this embodiment, intensive focusing lenses are formed at the ultrafocusing electrode 40 and the refracting power is used for deflection of electron beams. There is no need to apply any extremely large voltage to the ultrafocusing electrode 40. An image display apparatus of this embodiment controls the electron beams by using the lens action to land the electron beams on a predetermined fluorescent layer, and thus, electric power consumption can be considerably decreased compared to the case using a conventional controlling method.

Each focusing lens in this embodiment has an intensive focusing action and a certain refracting action, so that an electron beam emitted from an electron source at a predetermined position (with an angle) will be landed on a predetermined fluorescent layer. The electron beam will be focused intensively when being landed on the fluorescent layer. Therefore, if an electron beam is somewhat deviated before entering the ultrafocusing electrode 40 for some reasons such as position deviation of the electron source, the deviation will be more reduced as the electron beam is focused. As a result, deviation of the electron beam is reduced as the magnification of the electron beam focus is decreased (e.g., when the electron beam is focused to one-fifth, the deviation also will be reduced to one-fifth), and the landing position deviation caused by some errors including manufacturing error of each component can be minimized. An image display apparatus of this invention efficiently can prevent color deviation, luminance unevenness, etc., caused by variation in accuracy including errors in manufacturing each component composing the image display apparatus.

Electron beams emitted from any other electron sources (e.g., a first electron source 31$a$, a second electron source 31$b$, a third electron source 31$c$, a fifth electron source 31$e$, a sixth electron source 31$f$, and a seventh electron source 31$g$) are controlled in the same manner as the electron beam from the fourth electron source 31$d$. The following is a brief explanation about the electron beam that is landed on the fluorescent layer 38 in the vicinity of the above area of the fourth electron source 31$d$.

An electron beam 35$a_5$ emitted from the first electron source 31$a$ enters the second focusing lens after being deflected to the right by two grades, and is landed on a predetermined fluorescent layer 38$a_5$ by the refracting action of the second focusing lens. An electron beam 35$b_4$ emitted from the second electron source 31$b$ enters the second focusing lens after being deflected to the right by one grade, and is landed on a predetermined fluorescent layer 38$b_4$ by the refracting action of the second focusing lens. An electron beam 35$b_5$ that is deflected to the right by two grades before entering the third focusing lens is landed on a predetermined fluorescent layer 38$b_5$ by the refracting action of the third focusing lens. An electron beam 35$c_3$ enters the second focusing lens vertically above the third electron source 31$c$, is focused to travel in a straight line without deflection, and is landed on a predetermined fluorescent layer 38$c_3$. An electron beam 35$c_4$ enters the third focusing lens after being deflected to the right by one grade, and is landed on a predetermined fluorescent layer 38$c_4$ by the refracting action of the third focusing lens. The electron beam emitted from the fourth electron source 31$d$ is already mentioned above.

An electron beam 35$e_2$ emitted from the fifth electron source 31$e$ enters the third focusing lens after being deflected to the left by one grade, and is landed on a predetermined fluorescent layer 38$e_2$ by the refracting action of the third focusing lens. An electron beam 35$e_3$ enters the fourth focusing lens vertically above the fifth electron source 31$e$, is focused to travel in a straight line, and is landed on a predetermined fluorescent layer 38$e_3$. An electron beam 35$f_2$ emitted from the sixth electron source 31$f$ enters the fourth focusing lens after being deflected to the left by one grade, and is landed on a predetermined fluorescent layer 38$f_2$ by the refracting action of the fourth focusing lens. An electron beam 35$f_1$ enters the third focusing lens after being deflected to the left by two grades, and is landed on a predetermined fluorescent layer 38$f_1$ by the refracting action of the third focusing lens. An electron beam 35$g_1$ enters the fourth focusing lens after being deflected to the left by two grades, and is landed on a predetermined fluorescent layer 38$g_1$ by the refracting action of the fourth focusing lens.

Electron beams emitted from all electron sources are controlled in the above-mentioned manner. Therefore, in this embodiment, resolution of an image display apparatus can be improved in a relatively simple manner without hastily increasing the number of both the electron sources 31 and slits of the ultrafocusing electrode 40, but by increasing the number of deflection grades at the electrode 34. In this embodiment, the electrode 34 is provided to sandwich the electron beams 35 in a horizontal direction and to deflect the electron beams 35 in five grades. This invention, however, is not limited to this configuration, but the electron beams 35 can be deflected in more grades by, for example, controlling potential supplied between a pair of electrodes (34$a$, 34$b$) in more grades (e.g., supplying a voltage in at least six grades). The resolution of the image display apparatus can be further improved as deflection grades are increased.

The electron emission source 33, the electrode 34, the fluorescent layer 38, the vacuum container 39 and ultrafocusing electrode 40 are thin and flat plate components. As a result, an image display apparatus, formed by containing in the vacuum container 39 a lamination of the electron emission source 33, the electrode 34, the ultrafocusing electrode 40 and the fluorescent layer 38, is a thin image display apparatus having a flat screen.

The image display apparatus in this embodiment has a structure to deflect the electron beam 35 in a horizontal direction (the electrode 34 and the ultrafocusing electrode 40 sandwich the electron beam 35 in a horizontal direction respectively). This invention, however, is not limited to this, but it also can be formed to deflect the electron beam 35 vertically. Or the image display apparatus may be formed to enable deflection of the electron beam 35 in both horizontal and vertical directions.

(A Second Embodiment)

Figure 4:
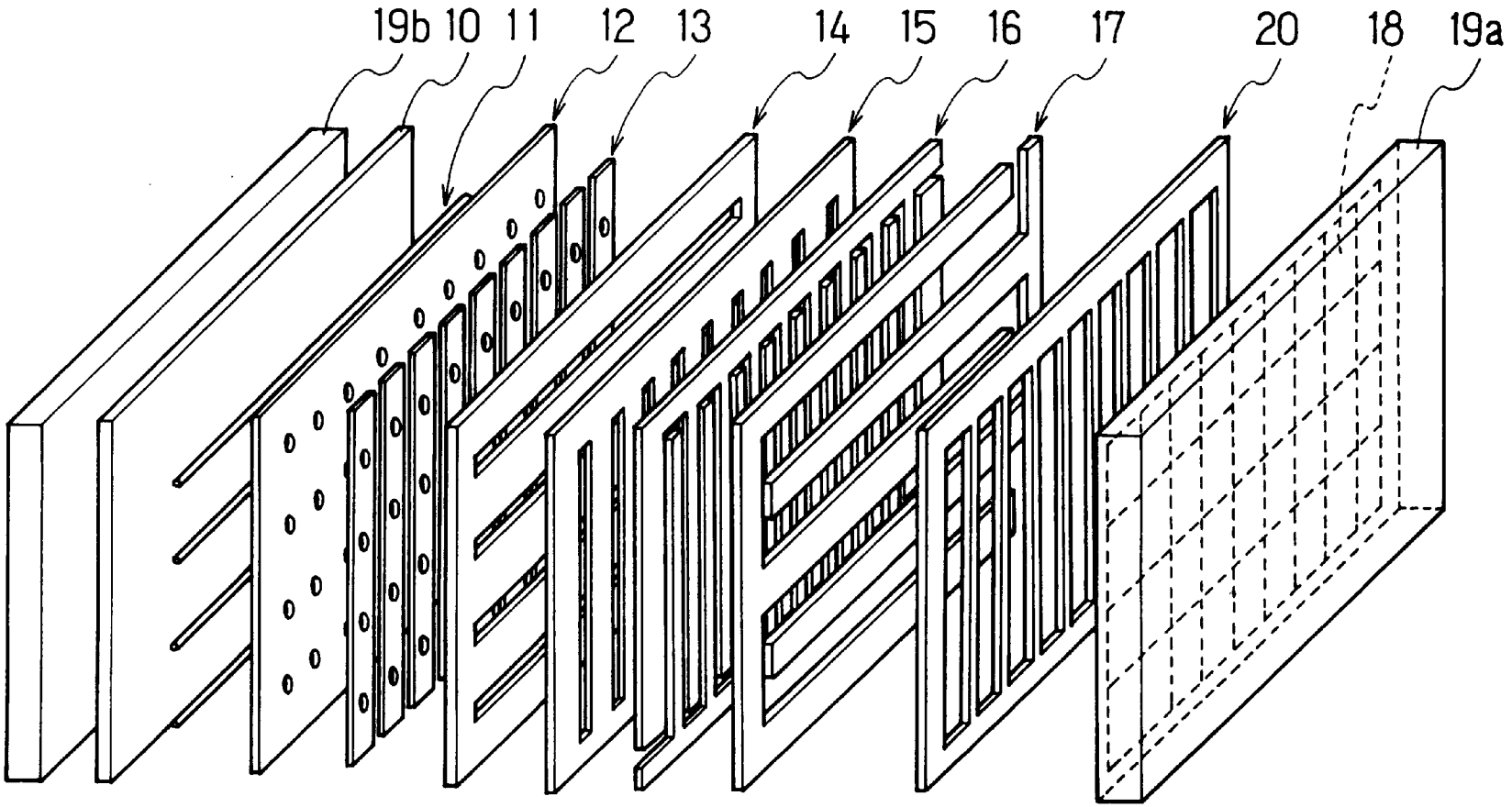
FIG. 4 is a perspective exploded view showing an image display apparatus in a second embodiment of this invention.

FIG. 4 is a perspective exploded view showing an image display apparatus in the second embodiment of this invention. As shown in FIG. 4, an image display apparatus in this embodiment comprises a back electrode 10, a linear cathode 11, an electron beam-attracting electrode 12, a control electrode 13, a first focusing electrode 14, a second focusing electrode 15, a horizontal deflecting electrode 16, a vertical deflecting electrode 17 and an ultrafocusing electrode 20. The components are arranged between a rear glass panel 19*b* and a front glass panel 19*a* having a fluorescent layer 18 on the inner surface (a fluorescent layer 18 side). These components are contained in an appropriate vacuum container, and the vacuum container is closely sealed. The inside of the vacuum container may have a degree of vacuum in a range between $10^{-6}$ and $10^{-8}$ torr.

In an image display apparatus in this embodiment, a plurality of linear cathodes 11 are strung in parallel while the electron beam-attracting electrode 12 is provided with holes in a matrix at the position to face the linear cathodes 11. Electron beams are formed in a matrix by these linear cathodes 11 and the electron beam-attracting electrode 12. The control electrode 13 controls electron beams over time and adjusts each electron beam independently according to picture signals to display pixels. The electron beams formed in a matrix are focused by the first focusing electrode 14 and the second focusing electrode 15, and deflected by the horizontal deflecting electrode 16 and the vertical deflecting electrode 17. The electron beams controlled by these components comprising the focusing electrodes (14, 15) and the deflecting electrodes (16, 17) approach to the predetermined positions of the ultrafocusing electrode 20. The ultrafocusing electrode 20 functions to further focus the electron beams and to land the electron beams on the predetermined positions of the fluorescent layer 18. A predetermined voltage is applied to the ultrafocusing electrode 20, and thus, focusing lenses are formed between pairs of electrodes composing the ultrafocusing electrode 20.

The ultrafocusing electrode 20 in this embodiment has similar functions as the ultrafocusing electrode 40 in the first embodiment, that is, the ultrafocusing electrode 20 comprises focusing lenses having certain focusing power and refracting power. As a result, electron beams with restricted spot diameter can be landed with high accuracy on predetermined positions of the fluorescent layer 18 by determining positions to emit electron beams that enter the focusing lenses (attracted in a matrix) and positions of the focusing lenses. If electron beams are deviated before entering the ultrafocusing electrode 20 because of errors including manufacturing errors during assembling the components into an image display apparatus, the deviation will be decreased as it is focused, since the electron beams are further focused by the focusing lenses formed at the ultrafocusing electrode 20 before being landed on the fluorescent layer 18. When an electron beam is focused to one-fifth, for example, the deviation will also be reduced to one-fifth. The multiplier effect will reduce the possibility of overlap irradiation and error irradiation. As a result, the landing position deviation caused by some errors including manufacturing errors can be minimized.

Respective components for the image display apparatus are thin and flat plates, therefore, an image display apparatus formed by assembling these components is a thin image display apparatus with less depth and a flat screen.

(A Third Embodiment)

Figure 5:
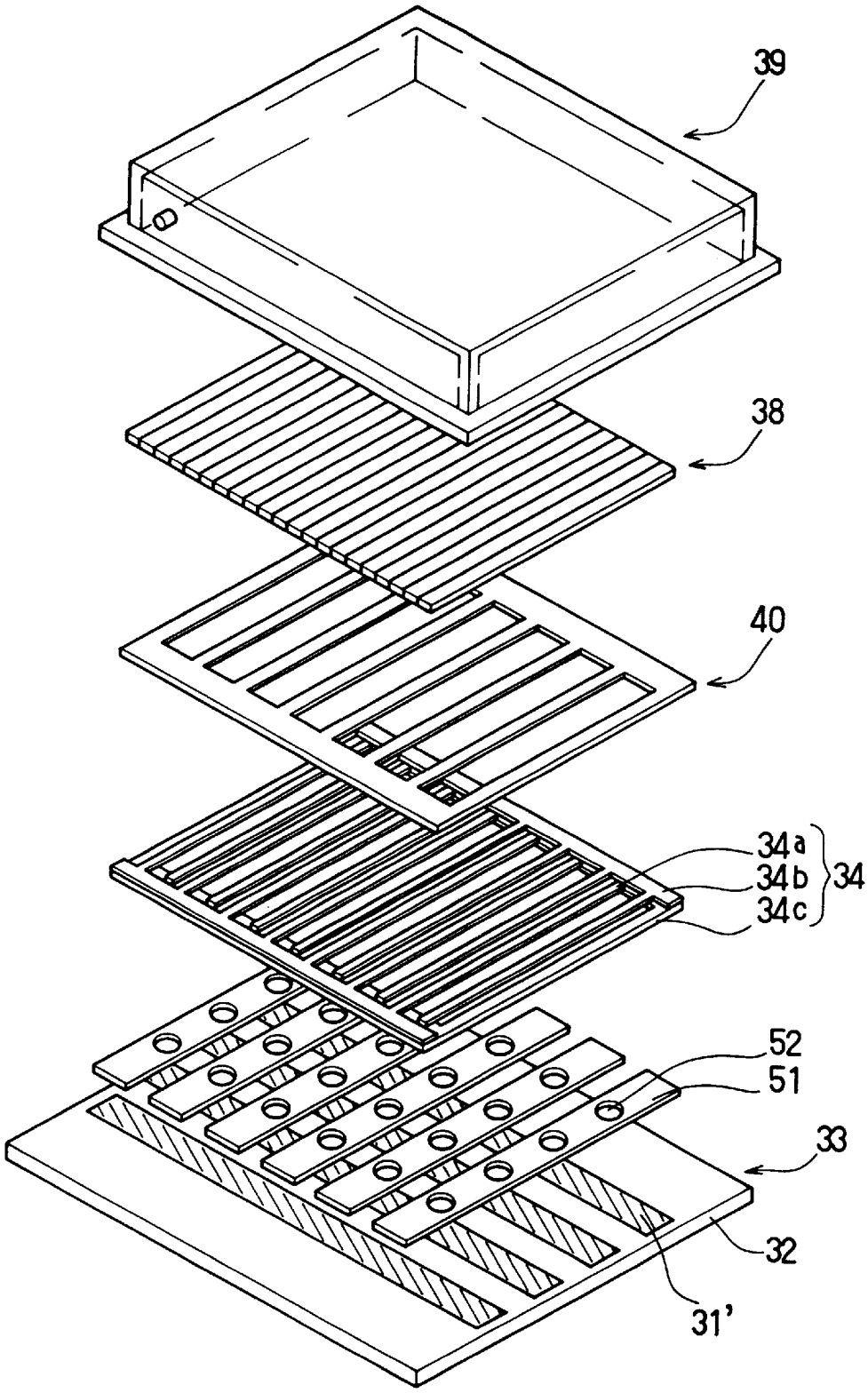
FIG. 5 is a perspective exploded view showing an image display apparatus in a third embodiment of this invention.

FIG. 5 is a perspective exploded view showing an image display apparatus in a third embodiment of this invention. Basically, an image display apparatus of this embodiment has the same structure as that of the first embodiment (refer to FIG. 1) excepting the structure of the electron emission source. As shown in FIG. 5, control electrode 51 is provided additionally, and the patterned geometry of an electron source 31' on an insulating substrate 32 is changed from that of the first embodiment.

The control electrode 51 is divided electrically and arranged in stripes, and holes 52 are provided at the position where a predetermined electron beam passes through so that electrons can pass through the holes 52. In the same way, the electron sources 31' formed on the insulating substrate 32 are patterned in stripes in the direction which is perpendicular to the dividing direction of the control electrode 51 and the electron sources are separated electrically. Further, when electrons are not emitted, the control electrode 51 to the potential of the stripe-arranged electron sources 31' is negative or the potential difference between the control electrode 51 and the strip-arranged electron sources 31' is very low.

When the potential of some control electrode 51 is selected to be positive, and the potential of some stripe-arranged electron sources 31' is selected be negative, only the potential difference of the cross section of the selected control electrode and the selected stripe-arranged electron sources becomes large, and electrons are emitted from the cross section of the electron sources 31' (attraction of electron). Electrons emitted from the selected cross section pass through holes 52 provided on a control electrode 51 (selective transmission) in the direction of a fluorescent layer 38. After that the electrons pass in the same way as those of the first embodiment, and therefore the explanation will be omitted.

According to the image display apparatus having the above-mentioned structure and function of this embodiment, even if electron sources are not provided in a matrix on essentially the same surface, the electron sources can be used as an electron source which can emit electron beams in a matrix by additionally providing a control electrode 51. That is, the combination of the control electrode 51 having the above-mentioned structure and the electron sources 31' can be considered as an electron emission source having electron sources arranged in a matrix.

Further, in the above-mentioned embodiment, a case in which a control electrode 51 is provided on one surface was explained. However, a function of attracting electrons due to the potential difference and a function of selective transmission may be achieved by at least two electrodes, for example, a plurality of electrodes may be provided in the direction in which electrons are emitted from electron sources. According to the above-mentioned structure, the same effect can be obtained.

(A Fourth Embodiment)

Figure 6:
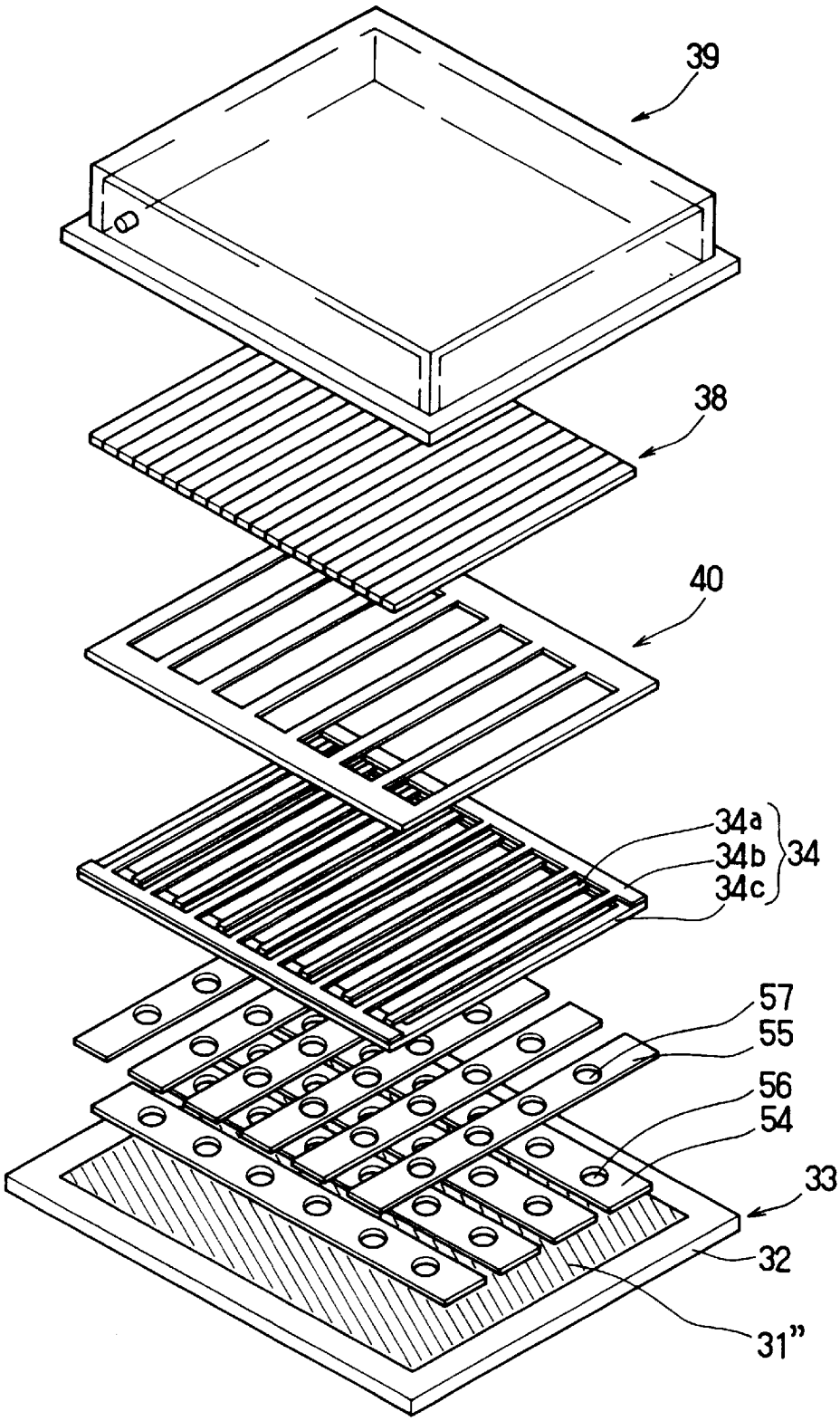
FIG. 6 is a perspective exploded view showing an image display apparatus in a fourth embodiment of this invention.
Figure 7:
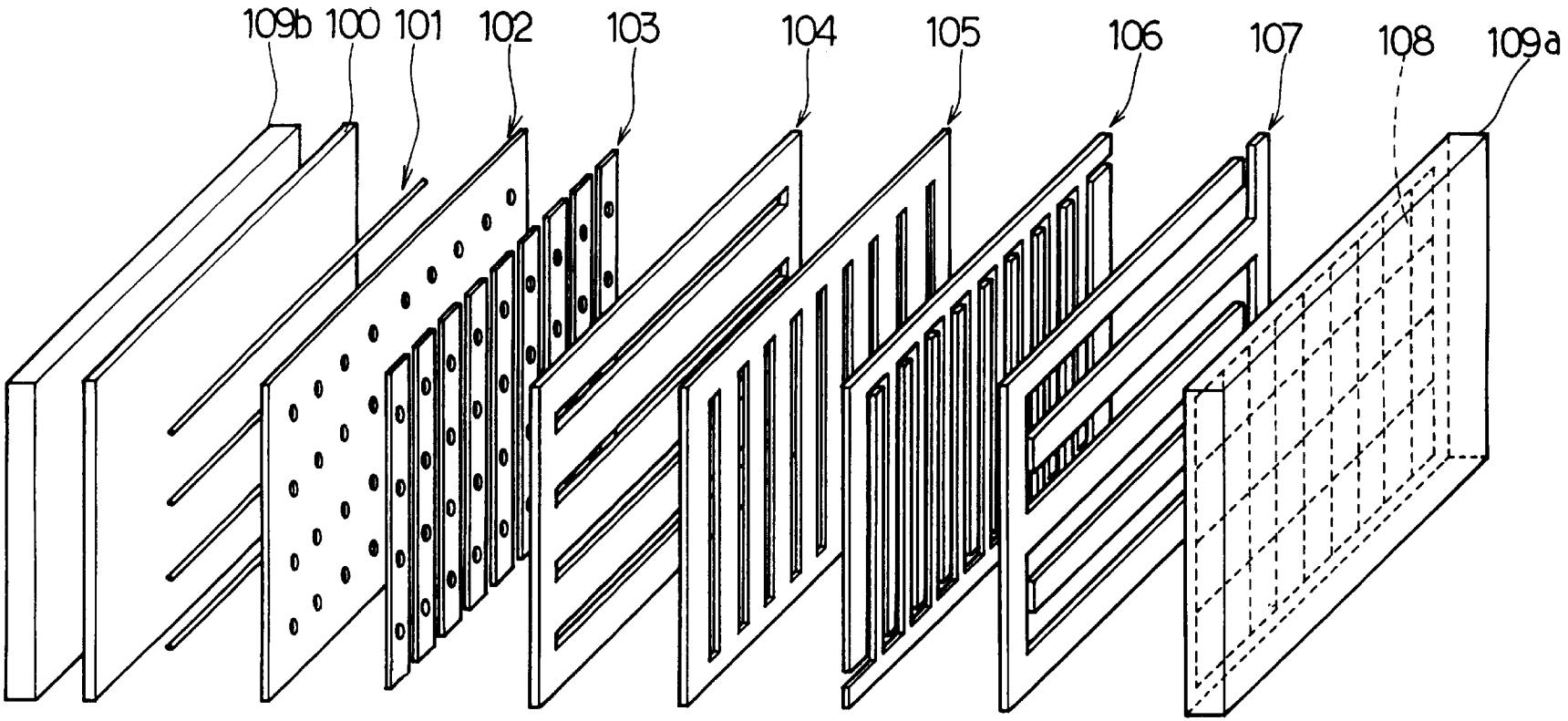
FIG. 7 PRIOR ART
FIG. 7 is a perspective exploded view showing a first conventional image display apparatus.
Figure 8:
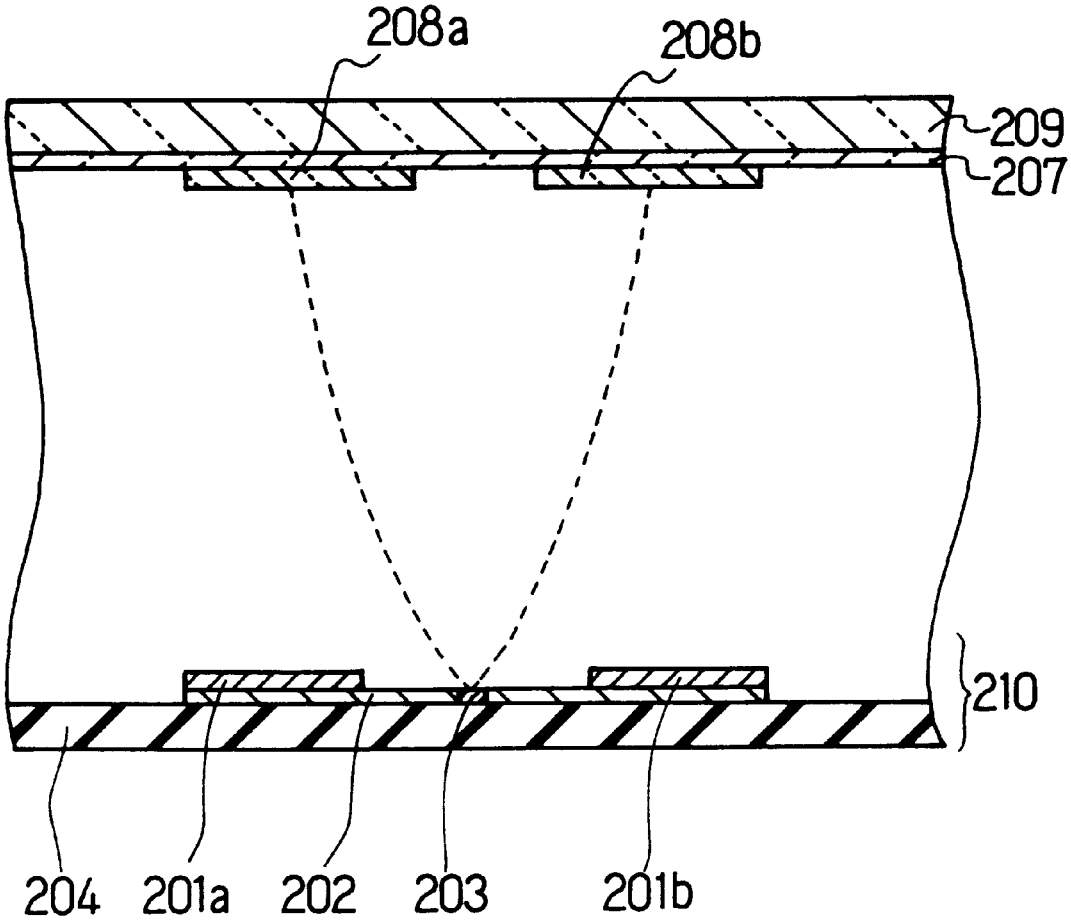
FIG. 8 PRIOR ART
FIG. 8 is a cross-sectional view showing the schematic structure of a second conventional image display apparatus.

FIG. 6 is a perspective exploded view showing an image display apparatus in a fourth embodiment of this invention. Basically, an image display apparatus of this embodiment has the same structure as that of the first embodiment (refer to FIG.1) excepting the structure of the electron emission source. As shown in FIG. 6, an electron source 31" is arranged continuously over the surface of the substrate 32 and a plurality of control electrodes 54 and 55 are provided above the electron source 31" to emit electrons from electron source 31".

As shown in FIG. 6, the control electrodes 54 are divided electrically and arranged in stripes, and holes 56 are provided on the control electrodes 54 at the position where a predetermined electron beam passes through so that electrons can pass through the holes 56. In the same way, control electrodes 55 are divided electrically and arranged in stripes, and holes 57 are provided on the control electrodes 55 at the position corresponding to the holes 56. Consequently, an electron that passes through a hole 56 can pass through a hole 57. The control electrodes 54 and 55 are arranged to cross at right angles. An electron source 31" is arranged continuously over the surface of the insulating substrate 32. Further, when electrons are not emitted, the potential of the control electrodes 54 to the potential of the plane-formed electron source 31" is negative or the potential difference between the control electrodes 54 and the plane-formed electron source 31" is very low.

When the potential of some control electrodes 54 is selected to be positive, only the potential difference of the stripe part of the selected control electrode 54 becomes large, and electrons are emitted from the parts (attraction of electron). Electrons emitted from the selected stripe parts pass through all holes 56 provided on the control electrode 54. Next, when the potential of some control electrodes 55 is selected to be positive, and the potential of other control electrodes 55 is selected to be a cutoff potential, only the electron passing through a cross section of the selected control electrodes 54 and 55, of all electrons which pass through a hole 56, passes through a hole 57 provided on the control electrode 55 (selective transmission) in the direction of the fluorescent layer 38. After that the electrons pass in the same way as those of the first embodiment, and therefore the explanation will be omitted.

According to the image display apparatus having the above-mentioned structure and finction of this embodiment, even if an electron source 31" is arranged continuously over the surface of the substrate, the electron source can be used as an electron source which can emit electron beams in a matrix by providing two sets of control electrodes 54 and 55. That is, the combination of the control electrodes 54 and 55 having the above-mentioned structure and the electron source 31' can be considered as an electron emission source having electron sources arranged in a matrix.

In the above-mentioned embodiment, two sets of control electrodes are provided. However, an electrode having a finction of attracting electrons due to the potential difference may be provided additionally and a function of selective transmission may be achieved by two sets of control electrodes. That is, at least three sets of electrodes may be provided. According to the above-mentioned structure, the same effect can be obtained.

The various electrodes (e.g., focusing electrodes, deflecting electrodes and ultrafocusing electrodes) composing respective image display apparatuses in the above-mentioned embodiments can be formed by stringing metal wires on frames. Such an electrode can have a considerably flat structure by only stringing and maintaining the metal wires on a frame or the like. In addition, the pitch between the respective electrodes (metal wires) can be made fine in a relatively simple manner, and thus, the resolution of the image display apparatus can be improved.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. An image display apparatus comprising, in a vacuum container whose inside is kept under vacuum:

a fluorescent layer;

an electron emission source having an electron source;

a deflecting electrode having a function to deflect electron beams emitted from the electron emission source; and an ultrafocusing electrode having a function to focus the electron beams deflected at the deflecting electrode and to land the focused electron beams on predetermined positions of the fluorescent layer, wherein the ultrafocusing electrode has slits that are formed with a pitch equal to the array pitch of the electron beams, the fluorescent layer has stripes that are formed with a pitch of 1/N (N is an integer) of the slit pitch of the ultrafocusing electrode, the ultrafocusing electrode is arranged between the electron emission source and the fluorescent layer while the deflecting electrode is arranged between the electron emission source and the ultrafocusing electrode, the slits form focusing lenses upon application of a voltage to the ultrafocusing electrode, and the focusing lenses have predetermined focusing power and refracting power to land the electron beams on the predetermined positions of the fluorescent layer and illuminate the fluorescent layer.

2. The image display apparatus according to claim 1, wherein the electron emission source has a plurality of electron sources arranged in a matrix.

3. The image display apparatus according to claim 1, wherein the electron emission source has a plurality of electron sources divided in stripes.

4. The image display apparatus according to claim 1, wherein the electron emission source has an electron source continuously arranged on a surface.

5. The image display apparatus according to claim 1, wherein the electron emission source has a plurality of linear cathodes strung in parallel.

6. The image display apparatus according to claim 1, wherein the distance from the fluorescent layer to the ultrafocusing electrode is shorter than the distance from the ultrafocusing electrode to a deflecting electrode located at the closest position to the ultrafocusing electrode.

* * * * *